US007611369B2

(12) United States Patent
Matsunaga

(10) Patent No.: US 7,611,369 B2
(45) Date of Patent: Nov. 3, 2009

(54) CONNECTOR

(75) Inventor: Hideki Matsunaga, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 12/177,970

(22) Filed: Jul. 23, 2008

(65) Prior Publication Data

US 2009/0035976 A1 Feb. 5, 2009

(30) Foreign Application Priority Data

Aug. 1, 2007 (JP) ..... 2007-200703
Aug. 1, 2007 (JP) ..... 2007-200711

(51) Int. Cl.
*H01R 13/52* (2006.01)

(52) U.S. Cl. ..... 439/271

(58) Field of Classification Search ..... 439/271, 439/272–277

See application file for complete search history.

(56) References Cited

U.S. PATENT DOCUMENTS 7,097,483 B2 * 8/2006 Hayashi ..... 439/271
7,371,115 B1 * 5/2008 Hsieh et al. ..... 439/587
7,419,395 B2 * 9/2008 Tsuji et al. ..... 439/271

FOREIGN PATENT DOCUMENTS

JP 2004-281370 10/2004

* cited by examiner

*Primary Examiner*—Gary F. Paumen
(74) *Attorney, Agent, or Firm*—Gerald E. Hespos; Anthony J. Casella

(57) ABSTRACT

A male housing (30) has a tubular part (32) with inner and outer tubes (36, 37) separated by a groove (38). A female housing (10) has a fit-in portion (14) to be fit in the inner tube (36). A seal ring (18) is mounted on the fit-in portion (14) and is compressed between opposed surfaces of the fit-in portion (14) and the outer tube (37). Loosening prevention portions (19) on the fit-in portion (14) fill a gap between the opposed surfaces of the fit-in portion (14) and the inner tube (36) and prevent both housings (10, 30) from being radially loosened.

18 Claims, 11 Drawing Sheets

CONNECTOR

BACKGROUND OF THE INVENTION

1. Field of the Invention

The invention relates to a connector having a waterproof function.

2. Description of the Related Art

Japanese Patent Application Laid-Open No. 2004-281370 discloses a connector having a waterproof function and a vibration preventing function. The connector has female and male housings that fit together. The female housing has a terminal accommodation part for accommodating female terminal fittings therein and a protection cylindrical part surrounding the terminal accommodation part. The male housing has a cylindrical part that surrounds the tabs of male terminal fittings. The cylindrical part of the male housing can be inserted into the gap between the terminal accommodation part and the protection cylindrical part of the female housing. A seal ring for waterproofing is mounted on the rear end of the peripheral surface of the terminal accommodation part. A loosening prevention member is mounted forward from the seal ring for preventing loosening of the housings. A gap between the terminal accommodation part and the cylindrical part is filled with the loosening prevention member to prevent the housings from loosening radially.

The seal ring and the loosening prevention member of the above-described connector contact the cylindrical part of the male housing. Therefore the seal ring applies an outward stress to the cylindrical part. There is a possibility that the cylindrical part will deform and open outward if both housings remain fit together for a long time. Additionally, the cylindrical part will deform readily if the housings are left in a high-temperature environment. There is a fear that a gap will be generated between the cylindrical part and the loosening prevention member if the cylindrical part deforms and opens outward. In this case, the loosening prevention member is incapable of sufficiently displaying its loosening prevention function.

The loosening prevention portion of the above-described connector is a separate part from the female housing. Therefore there is a possibility that the loosening prevention portion may deviate from the position of the terminal accommodation part while mounting the loosening prevention portion on the terminal accommodation part. Thus there is a possibility that the loosening prevention portion will not display its loosening prevention function.

The loosening prevention portion could be formed integrally with the terminal accommodation part of the female housing in an effort to prevent the above-described problem from occurring. However, the peripheral surface of the terminal accommodation part of the female housing is curved to mount a seal ring thereon. In forming the loosening prevention portion integrally with the peripheral surface of the terminal accommodation part, it is difficult to control the accuracy of a projected amount of the loosening prevention portion with respect to the peripheral surface of the terminal accommodation part and thus it is difficult to allow the loosening prevention portion to display its loosening prevention function.

The invention has been completed in view of the above-described situation. Therefore it is an object of the invention to provide a connector having a loosening prevention function.

SUMMARY OF THE INVENTION

The invention relates to a connector with first and second housings. The first housing has a tubular part and the second housing has a portion to be fit in the tubular part. A seal ring is compressed between opposed surfaces of the tubular part and the second housing to seal a gap between the first and second housings. At least one loosening prevention portion is disposed to fill a gap between the tubular part and the opposed surface of the second housing for preventing the first and second housings from loosening radially. The tubular part has inner and outer tubes and a groove is defined therebetween. One of the seal ring and the loosening prevention portion is disposed between the inner tube and the second housing. The other of the seal ring and the loosening prevention portion is disposed between the outer tube and the second housing.

The seal ring is compressed between the opposed surfaces of the tubular part and the second housing when both housings have been fit together. Thus the gap between both housings is sealed. Additionally, the gap between the opposed surfaces of the tubular part and the second housing is filled with the loosening prevention portion. As a result, both housings are prevented from radially loosening. Stress applied by the seal ring that is compressed in the fit-in state has only a slight degree of influence on the inner or outer tubes. Thus, the loosening prevention function will not deteriorate with age.

The groove preferably is rearward from the loosening prevention portion and the seal ring in a state in which both housings have been fit together. Thus, the stress applied by the seal ring has only a slight degree of influence on the inner or outer tubes.

The seal ring preferably is compressed by a front end of the inner or outer tubes. This construction allows stress generated by the seal ring to be received by the front end of the inner or outer tubes. Thus, stress generated by the seal ring has only a slight influence on the outer or inner tubes, as compared with the case where stress is applied to the rear of the inner or outer tubes.

The second housing may have a fit-in portion fit in the tubular part. The loosening prevention portion is between the fit-in portion and the inner tube and the seal ring is between the fit-in portion and the outer tube. Thus, the seal ring can be mounted in the groove formed between the inner and outer tubes.

The outer tube may project forward beyond the inner tubes. Reinforcements connect regions of the inner and outer tubes rearward from a portion of the outer tube that contacts the seal ring. This construction strengthens the inner tube and also enhances the loosening prevention function. The portion of the outer tube that contacts the seal ring is not connected with the inner tube by the reinforcements. Thus a slight degree of influence of the stress is applied by the seal ring to the inner tube.

The reinforcements preferably are circumferentially coincident with the loosening prevention portions. Thus, the loosening prevention function is enhanced to a high extent.

The outer tube may project forward beyond the inner tube. A forcible fit-in prevention piece projects forward from a rear wall of the inner tube for preventing the second housing from being fit in the first housing while inclined to a normal fit-in posture thereof. The front end of the forcible fit-in prevention piece is between front ends of the inner and outer tubes. In this construction, the forcible fit-in prevention piece can prevent the second housing from interfering with the inner tube while the second housing is being fit in the first housing. Thus, the loosening prevention portion between the second housing and the inner tube prevents deformation of the inner tube and displays the loosening prevention function. The forcible fit-in prevention piece is rearward from the outer tube so that the outer tube protects the forcible fit-in prevention piece.

The loosening prevention portion preferably is formed integrally with at least one of the first and second housings.

The second housing preferably has a fit-in portion to be fit in the tubular part. The seal ring is mounted on a surface of the fit-in portion opposed to the tubular part, and the loosening prevention portion is provided on the surface of the fit-in portion opposed to the tubular part. The seal ring is mounted on a curved surface on the fit-in portion opposed to the tubular part on which the seal ring is mounted. A flat surface is formed integrally with the loosening prevention portion at a position forward or rearward from the curved surface. In this construction, the curved surface confronts the cylindrical part on which the seal ring is mounted. Therefore the curved surface provides a sealing performance. The loosening prevention portion is formed integrally with the flat surface. Therefore it is easy to make dimensional management of the loosening prevention portion and it is possible to display the loosening prevention function.

A protrusion is formed rearward from the flat surface of the fit-in portion and protrudes radially out farther than the flat surface. The curved surface is formed on the protrusion, and hence the flat surface is disposed radially inward from the curved surface. Therefore, the loosening prevention portion will not interfere with the seal ring while mounting the seal ring on the fit-in portion. Accordingly, the seal ring will not be damaged and the sealing performance will not deteriorate.

DETAILED DESCRIPTION OF THE PREFERRED EMBODIMENTS

A connector in accordance with the invention is illustrated in FIGS. 1 through 11 and is identified by the letter C. The connector C has a female housing 10 and a male housing 30 that can be fit in the female housing 10. In the following description, the fit-in end of each housing 10 and 30 is referred to as the front, whereas the opposite end is referred to as the rear end. The vertical direction shown in FIGS. 1, 2, 4, and 7 is set as the reference.

Figure 2:
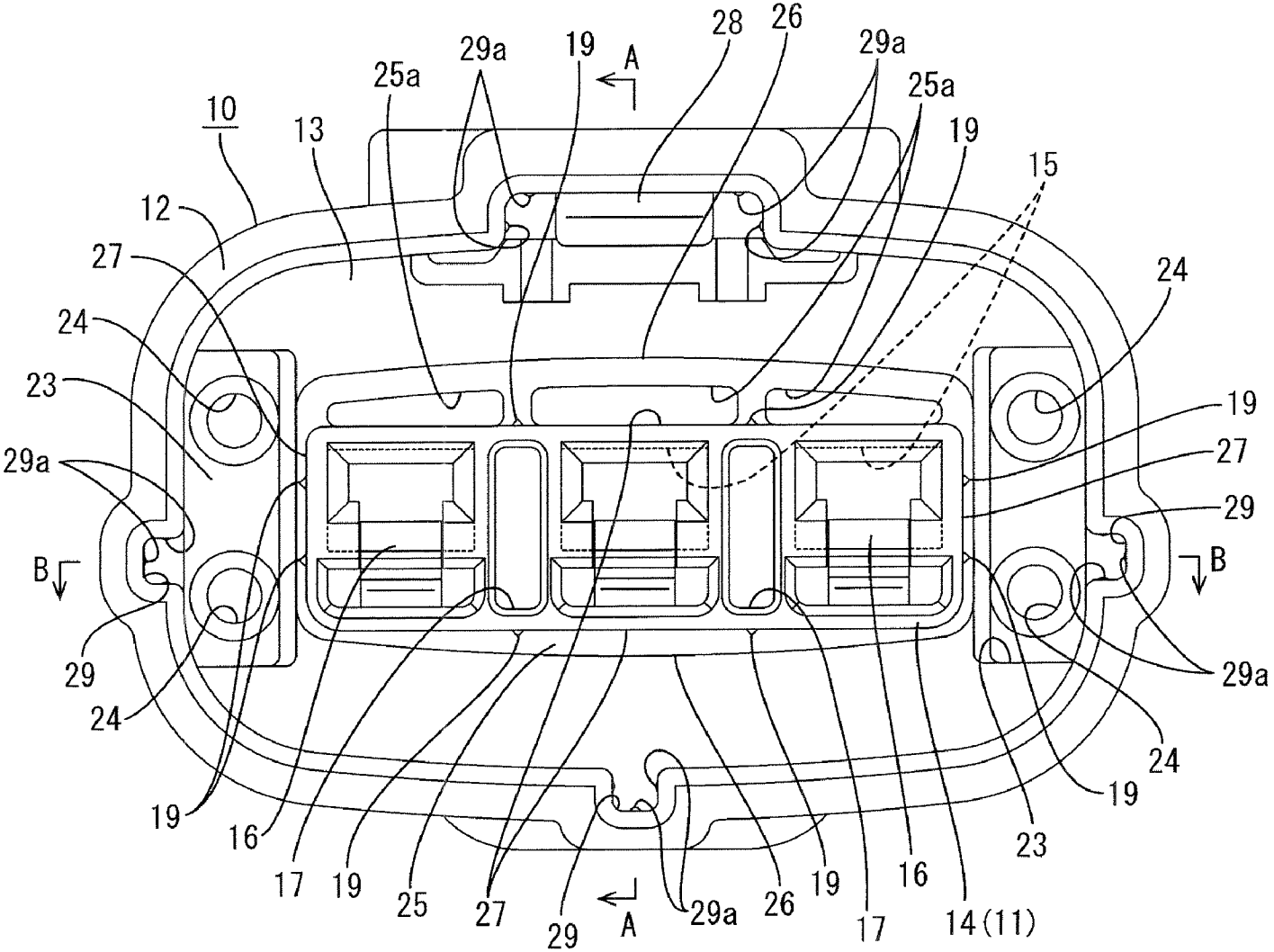
FIG. 2 is a front view of a female housing.
Figure 4:
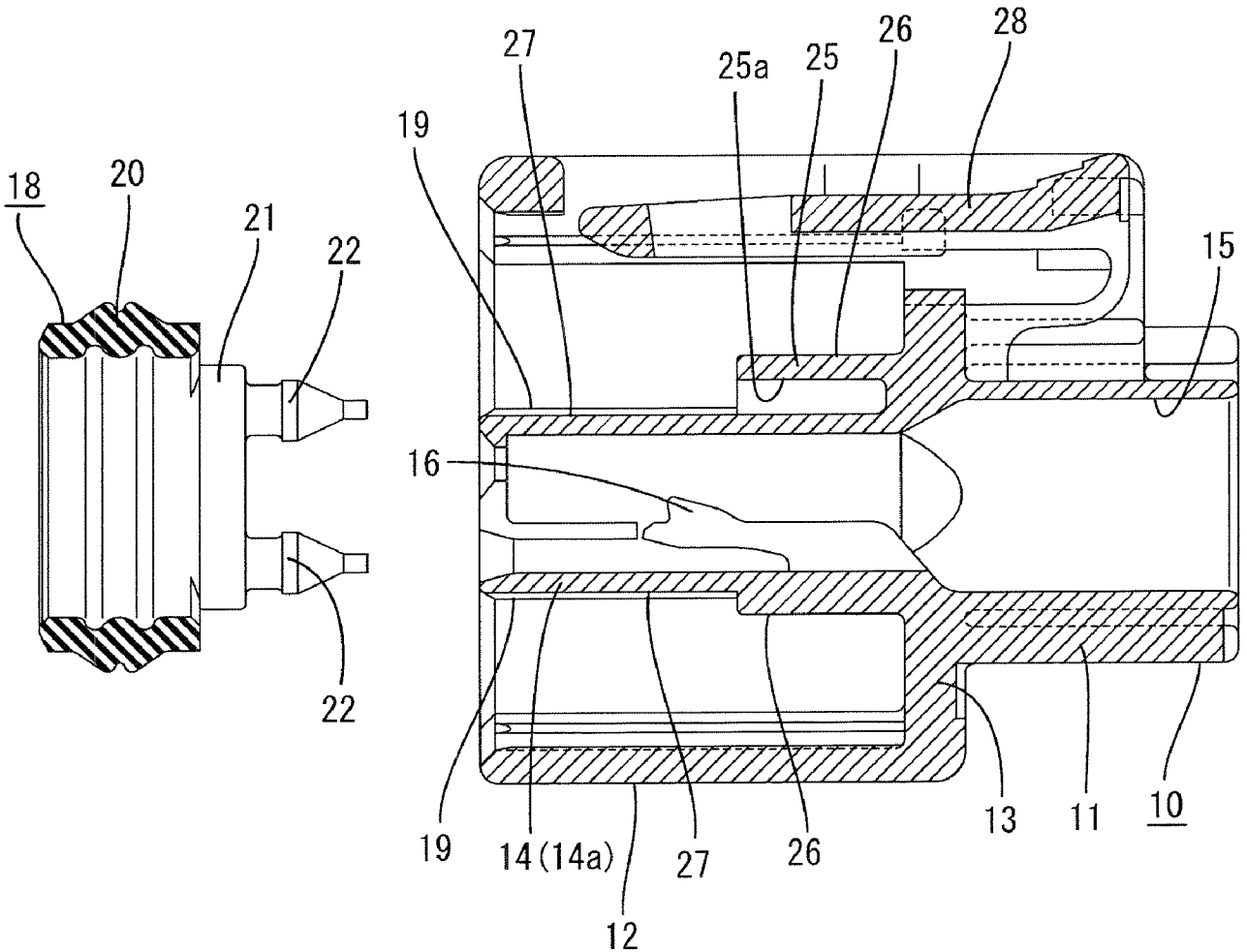
FIG. 4 is a sectional view, taken along a line A-A of FIGS. 2 and 3, which shows a state before the seal ring is mounted on the female housing.
Figure 5:
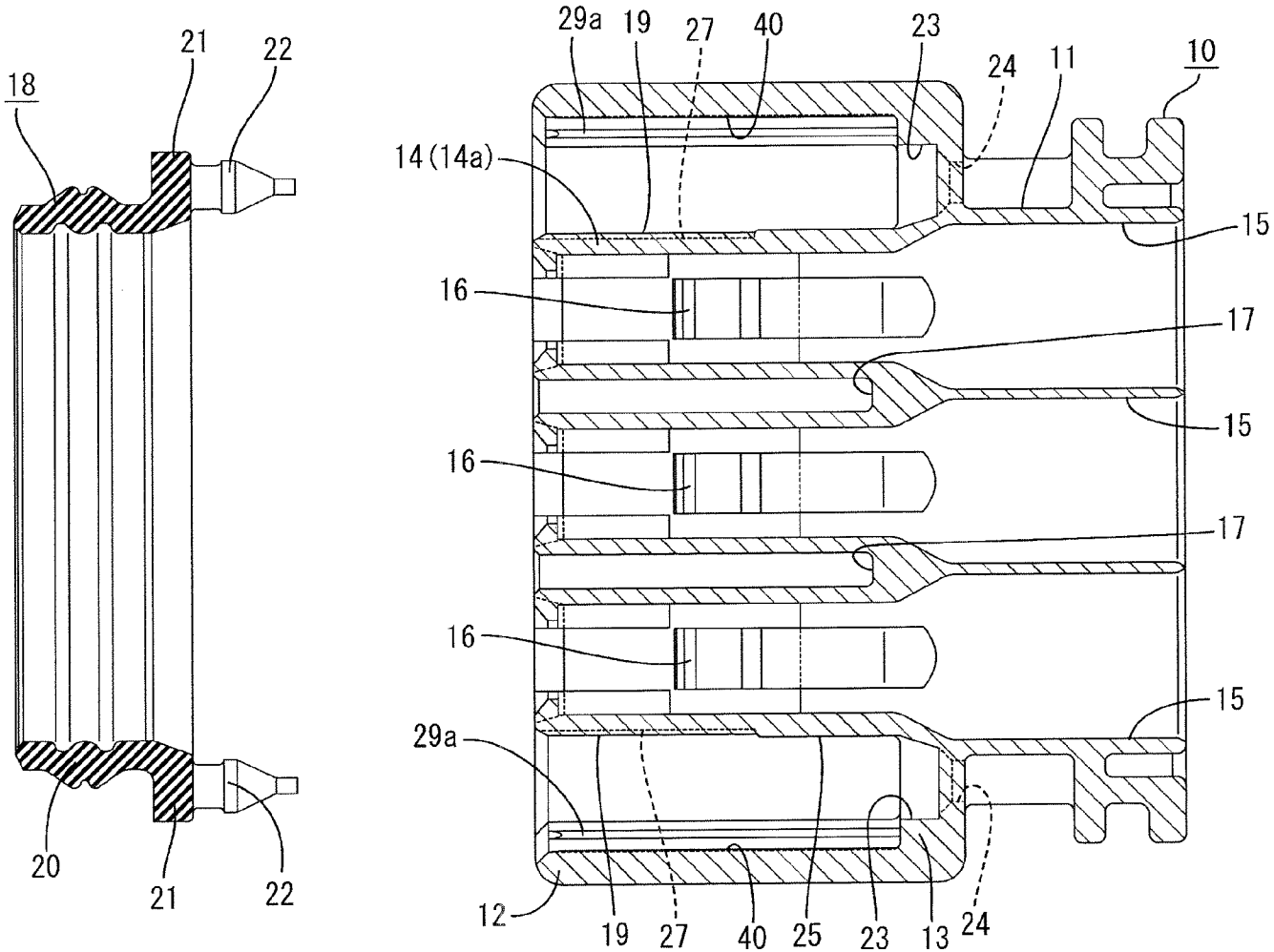
FIG. 5 is a sectional view, taken along a line B-B of FIGS. 2 and 3, which shows a state before the seal ring is mounted on the female housing.

The female housing 10 is made of synthetic resin. As shown in FIGS. 2, 4, and 5, the female housing 10 has a terminal accommodation part 11 that accommodates female terminal fittings connected respectively with ends of electric wires. The female terminal fittings and the wires are not shown in the drawings. The female housing 10 also includes a protection tube 12 disposed outwardly of the terminal accommodation part 11. A connection 13 extends radially out from the terminal accommodation part 11 and connects to the rear end of the protection tube 12. A fit-in portion 14 is defined adjacent the front end of the terminal accommodation part 11 and forward of the connection 13. The protection tube 12 surrounds the fit-in part 14 so that a forwardly open space is defined between the terminal accommodation part 11 and the protection tube 12 for receiving a part of the male housing 30, as explained herein.

The terminal accommodation part 11 is a wide oblong with an approximately block shape and has three cavities 15 into the female terminal fittings can be inserted from the rear. The three cavities 15 are arranged widthwise and penetrate through the terminal accommodation part 11 longitudinally. A lance 16 is cantilevered forward from a lower side of an inner peripheral surface of each cavity 15 and can deform elastically in the vertical direction to permit insertion of the female terminal fitting. However, the lance 16 returns resiliently to hold the inserted female terminal fitting in a removal-prevented state. A front half of the cavity 15 is sectionally quadrilateral in correspondence with the outer configuration of the female terminal fitting, whereas a rear half thereof is sectionally circular in correspondence with the outer configuration of a waterproof rubber stopper (not shown) mounted on the periphery of the electric wire. Thus, it is possible to position the female terminal fitting in the circumferential direction thereof and bring the waterproof rubber stopper into close contact with the inner peripheral surface of the cavity 15.

A front-end of the female housing 10 includes front-end surfaces of the terminal accommodation part 11 and the protection tube 12, which are substantially flush with one another. Forwardly open receiving grooves 17 are formed respectively in walls between the cavities 15 at the front surface of the terminal accommodation part 11. Each receiving groove 17 defines a long rectangle in a front view.

A seal ring 18 and loosening prevention ribs 19 are provided on a peripheral surface of the fit-in portion 14 of the terminal accommodation part 11 surrounded by the protection tube 12. The seal ring 18 seals a gap between the female and male housings 10 and 30. The loosening prevention ribs 19 prevent the female and male housings 10 and 30 from loosening radially.

Figure 3:
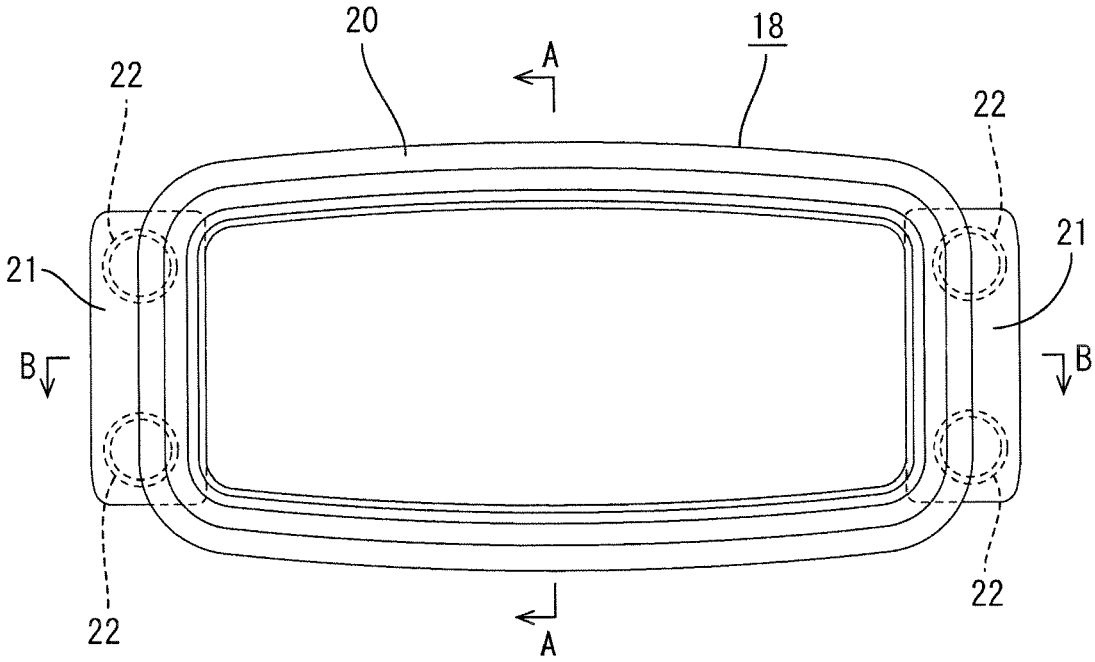
FIG. 3 is a front view of a seal ring.

The seal ring 18 is made of elastically deformable rubber. As shown in FIGS. 3 through 5, the seal ring 18 has an annular main body 20 that surrounds the periphery of the fit-in portion 14. Two ears 21 project sideways from a rear end of the main body 20 and a removal prevention projection 22 extends rearward from a rear end surface of each ear 21. The removal prevention projections 22 are spaced vertically at a certain interval.

Figure 6:
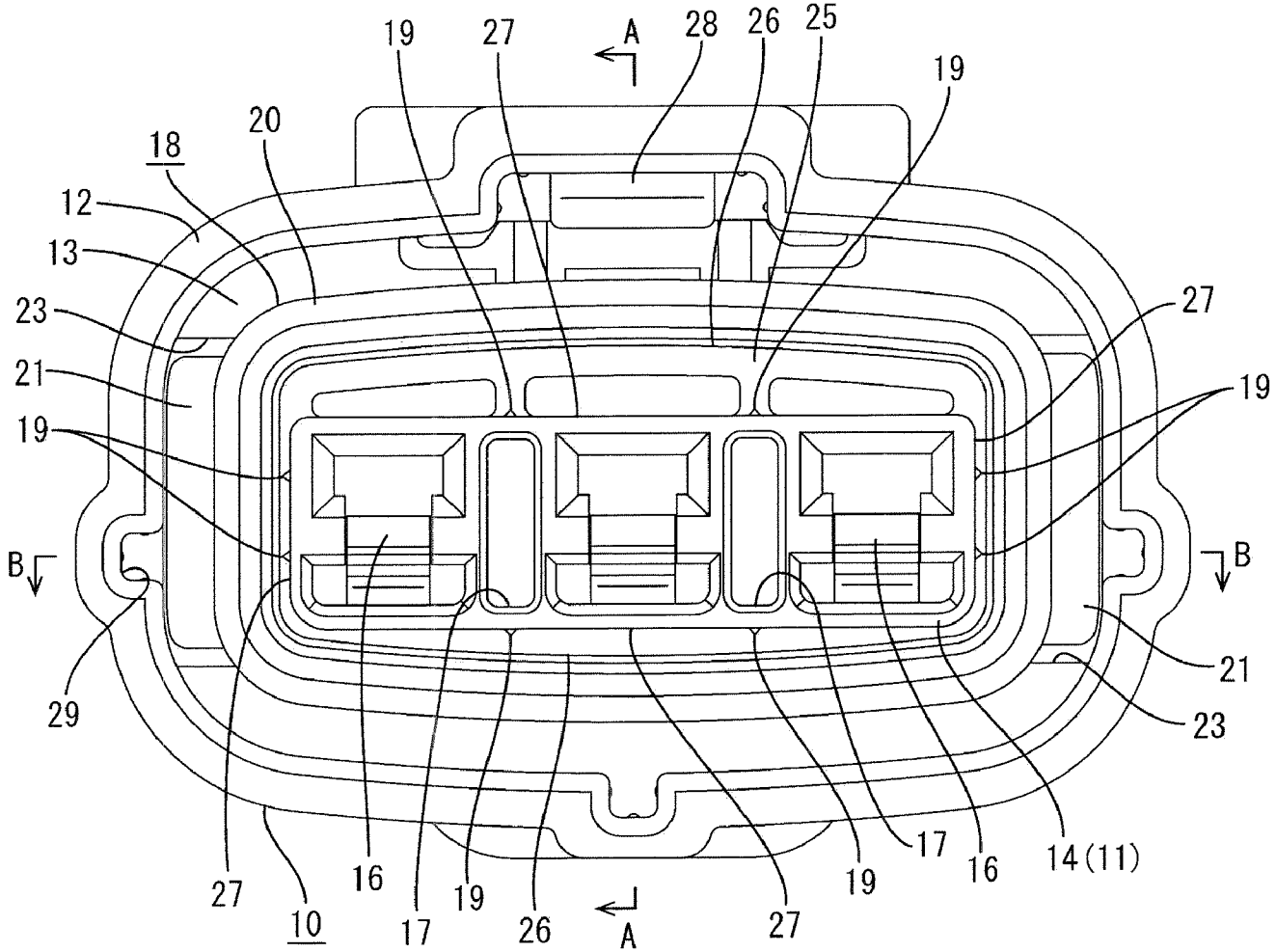
FIG. 6 is a front view showing a state in which the seal ring is mounted on the female housing.
Figure 7:
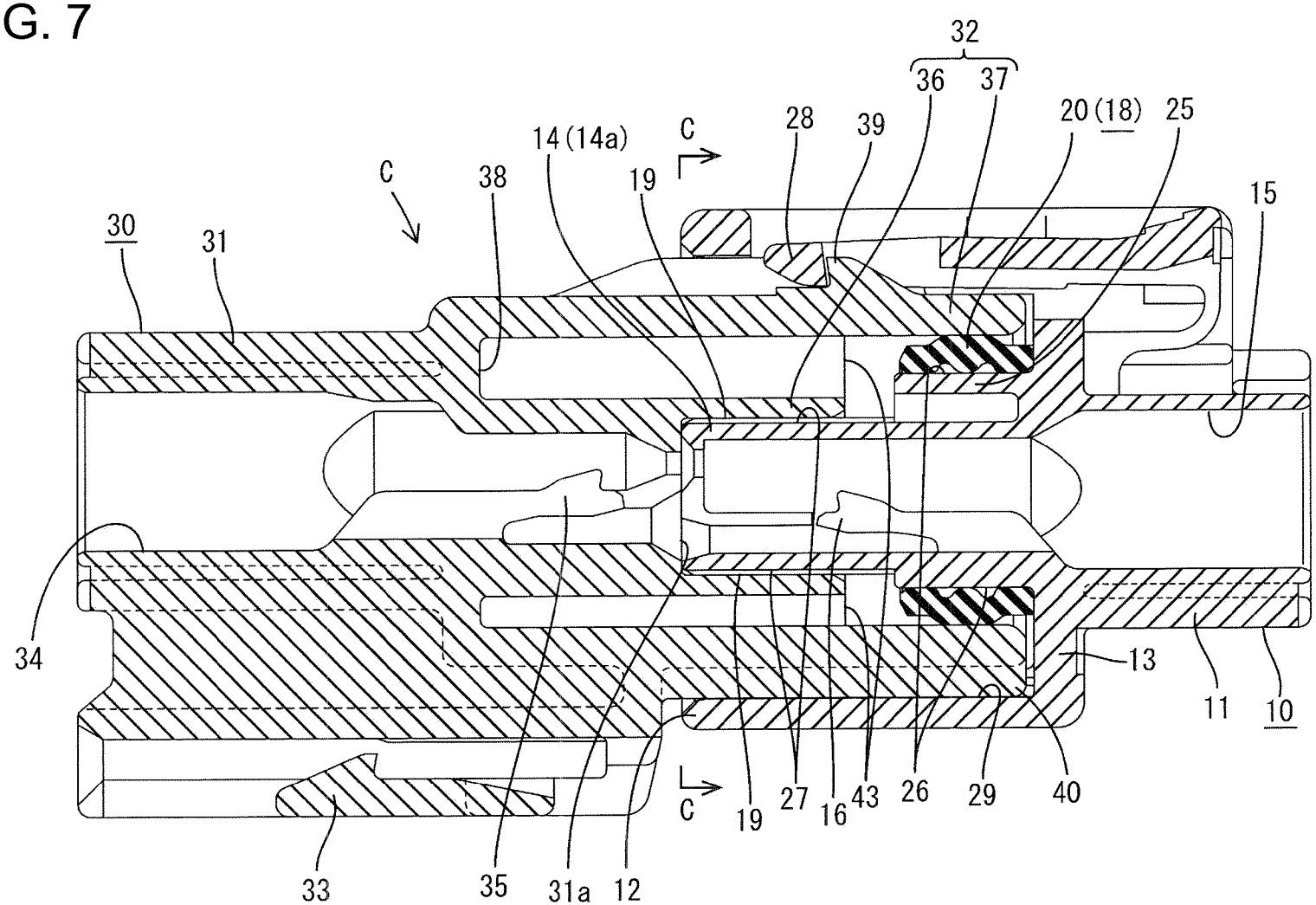
FIG. 7 is a sectional view, taken along a line A-A of FIGS. 1 and 6, which shows a state before both housings are fitted in each other.
Figure 8:
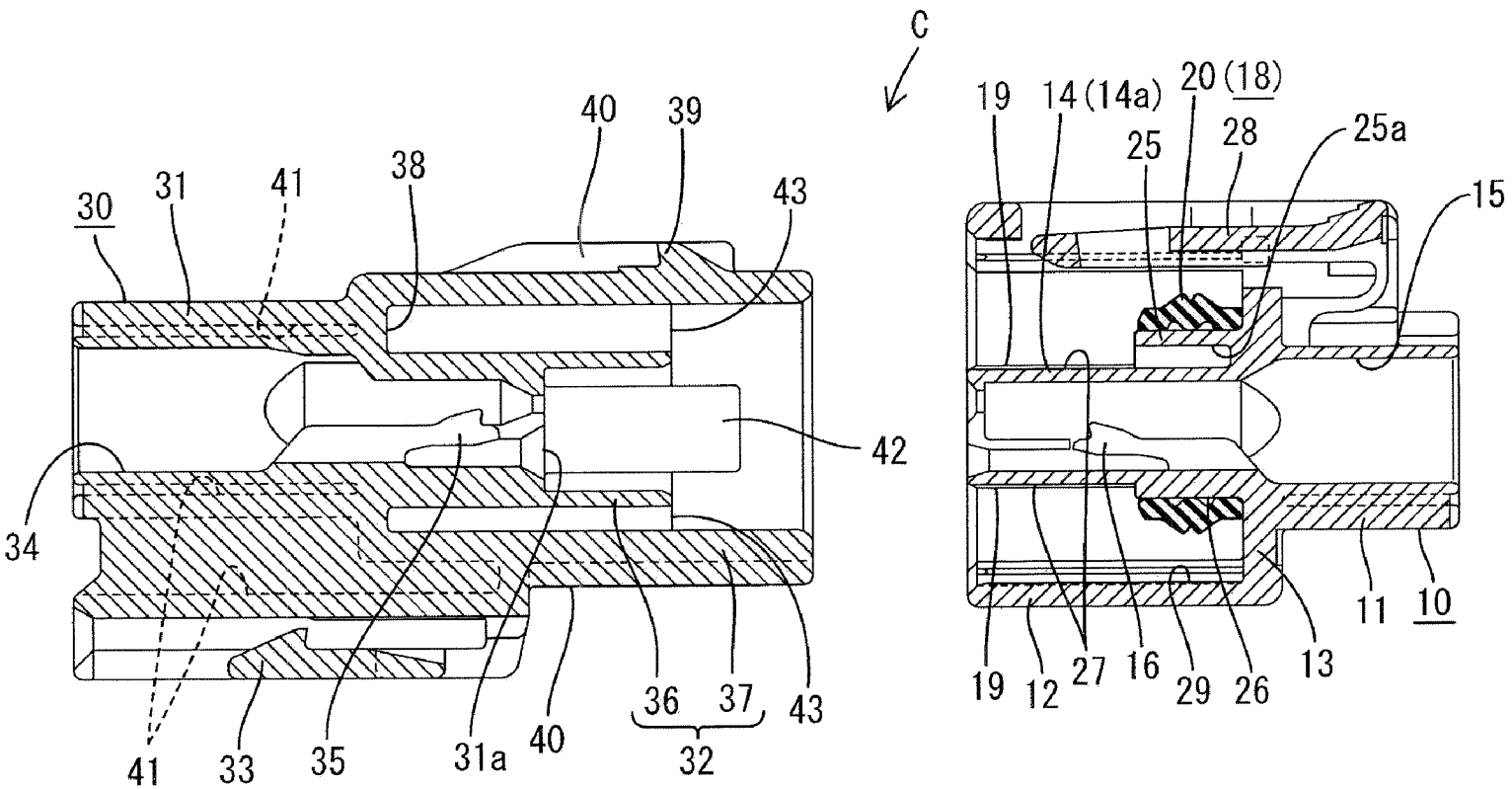
FIG. 8 is a sectional view, taken along a line B-B of FIGS. 1 and 6, which shows the state before both housings are fitted in each other.
Figure 9:
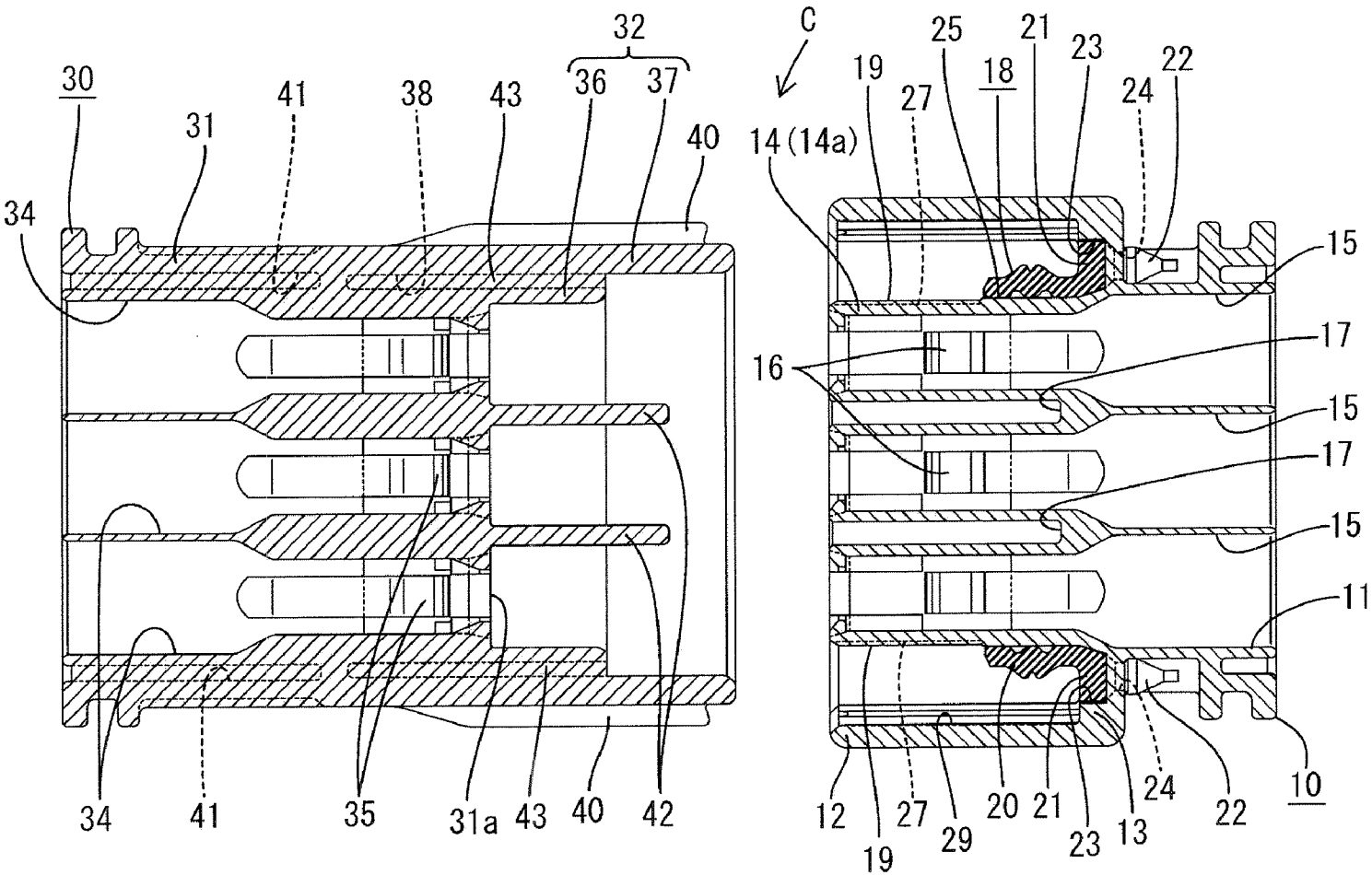
FIG. 9 is a sectional view, taken along a line A-A of FIGS. 1 and 6, which shows a state in which both housings have been fitted in each other.
Figure 10:
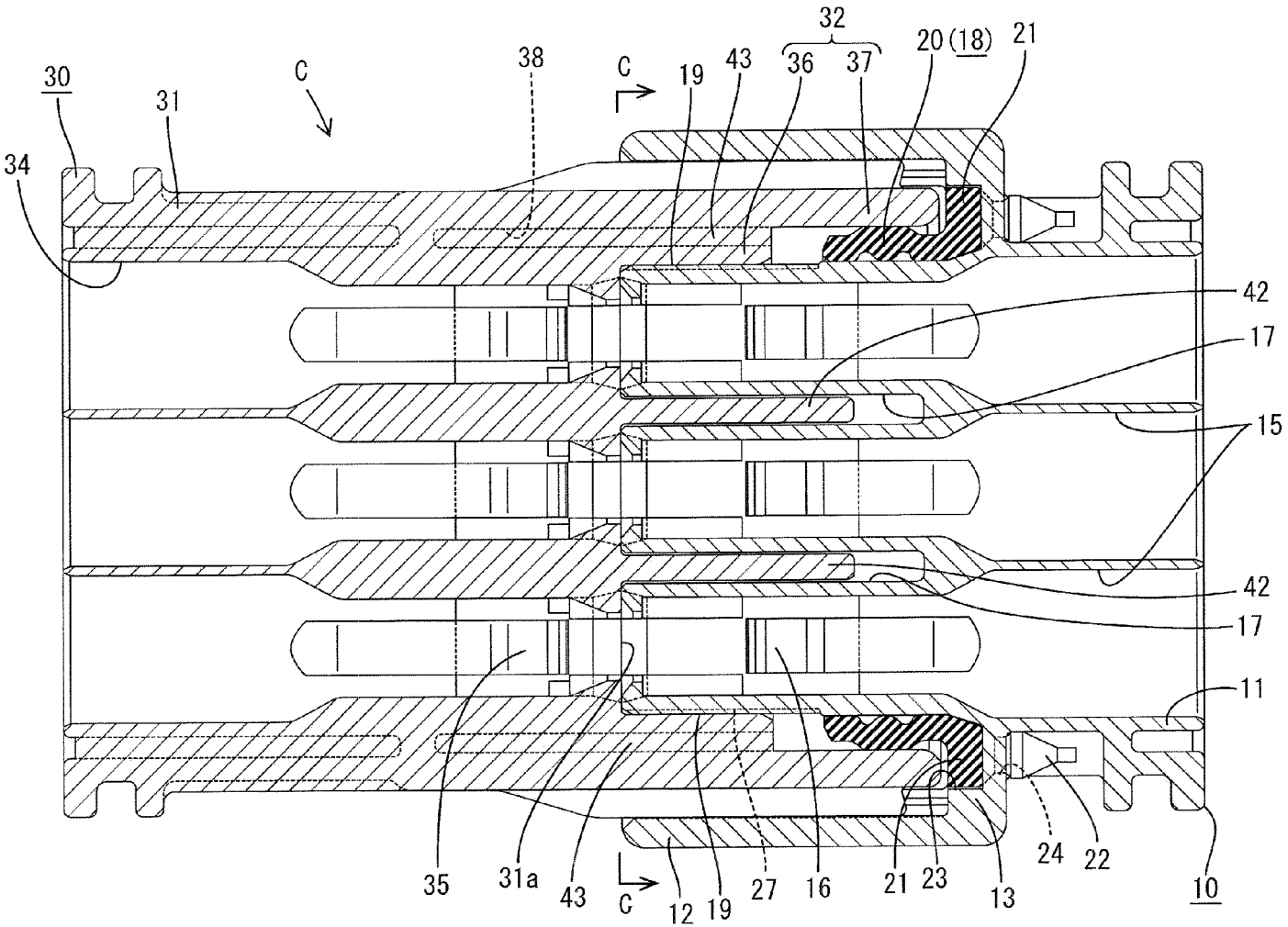
FIG. 10 is a sectional view taken along a line B-B of FIGS. 1 and 6 showing the state in which both housings have been fitted in each other.

The main body 20 of the seal ring 18 is fit on a rear end of the peripheral surface of the fit-in portion 14 when the seal ring 18 is mounted on the female housing 10, as shown in FIGS. 6 through 8. At this time, both ears 21 are fit into ear-receiving concavities 23 formed on a front surface of the connection part 13. Additionally, the removal prevention projections 22 are press fit respectively into circular removal prevention openings 24 formed through a bottom surface of the ear-receiving concavities 23 so that the removal prevention projections 22 penetrating through the respective removal prevention openings 24. A large-diameter portion on each removal prevention projection 22 is caught by a rear edge of each removal prevention opening 24 from the rear so that the seal ring 18 cannot be removed. The main body 20 of the seal ring 18 is compressed into close contact with the fit-in portion 14 and can seal the gap between the female and male housings 10 and 30 (FIGS. 9 and 10).

A protrusion 25 protrudes out from the rear end of the fit-in portion 14 on which the seal ring 18 is mounted and forwardly to a position beyond a front portion of the seal ring 18, as shown in FIGS. 2, 4, and 5. Convex curved surfaces 26 are formed on the wide upper and lower parts of the protrusion 25 that receive the seal ring 18 for enhancing the sealing performance of the seal ring 18. The curved surfaces 26 are configured so that the vertical height of the protrusion 25 is largest at the widthwise center thereof and becomes gradually smaller from the center to the sides. The side surfaces of the protrusion 25 are almost vertically straight. However, corners of the protrusion 25 at the curved surfaces 26 are rounded with curvatures smaller than the curved surfaces 26. The upper curved surface 26 of the protrusion 25 protrudes more than the side portions and lower portion thereof. Therefore, forwardly open recesses 25*a* are formed at three widthwise positions to prevent the generation of shrink marks during molding.

Flat surfaces 27 are formed on the periphery of the front portion 14*a* forward of the protrusion 25 and across the entire front portion 14*a* except the corners. The upper and lower flat surfaces 27 are substantially straight and flat in the width direction of the female housing 10, whereas the side flat surfaces 27 are straight in the vertical direction of the female housing 10.

The loosening prevention ribs 19 project out from spaced apart positions on the flat surfaces 27. More particularly, the loosening prevention ribs 19 are formed at two positions on each of the upper, lower and side flat surfaces 27. Thus, the loosening prevention ribs 19 are formed at eight positions. The loosening prevention ribs 19 on the upper and lower flat surfaces 27 align vertically with the receiving grooves 17. The loosening prevention ribs 19 on the flat side surfaces 27 are spaced vertically.

Each loosening prevention rib 19 projects out from the corresponding flat surface 27 and extends longitudinally over the entire length of the corresponding flat surface 27. A rear end of each loosening prevention rib 19 is connected with a front surface of the protrusion 25. Each loosening prevention rib 19 is tapered at a projected end thereof and in section has the shape of a triangle with an apex at the projected end. The projecting distance of each loosening prevention rib 19 is less than a minimum projected dimension at the sides of protrusion 25 with respect to the peripheral surface of the front portion 14*a*. Thus, projected ends of the loosening prevention ribs 19 are inward of the peripheral surface of the protrusion 25. As a result, the seal ring 18 will not interfere with the loosening prevention ribs 19 as the seal ring 18 is being mounted on the female housing 10. The projected ends of the loosening prevention ribs 19 contact the male housing 10 when the housings 10 and 30 are fit together to prevent the housings 10 and 30 from loosening radially.

As shown in FIGS. 2, 4, and 5, the protection tube 12 opens forwardly and has an oblong or square pillar shape. The protection tube 12 is spaced out from the fit-in portion 14 of the terminal accommodation part 11 to form a space for receiving a part of the male housing 30. The protection tube 12 protects the main body 20 of the seal ring 18 before the housings 10 and 30 are fit together.

A locking arm 28 is provided at an upper part of the protection tube 12 for holding the housings 10 and 30 in a fit-in state. Bulges bulge out from both sides of the protection tube 12 and from a lower portion thereof. Guide rib-receiving grooves 29 are provided on the inner sides of the bulges for receiving guide ribs 40 of the male housing 30. Loosening prevention projections 29*a* are formed at two positions of an inner peripheral surface of each guide rib-receiving groove 29 for filling the gap between the guide rib 40 and the guide rib-receiving groove 29. Two loosening prevention projections 29*a* also are provided on the inner peripheral surface of the upper portion of the protection tube 12 at opposite sides of the locking arm 28.

Figure 1:
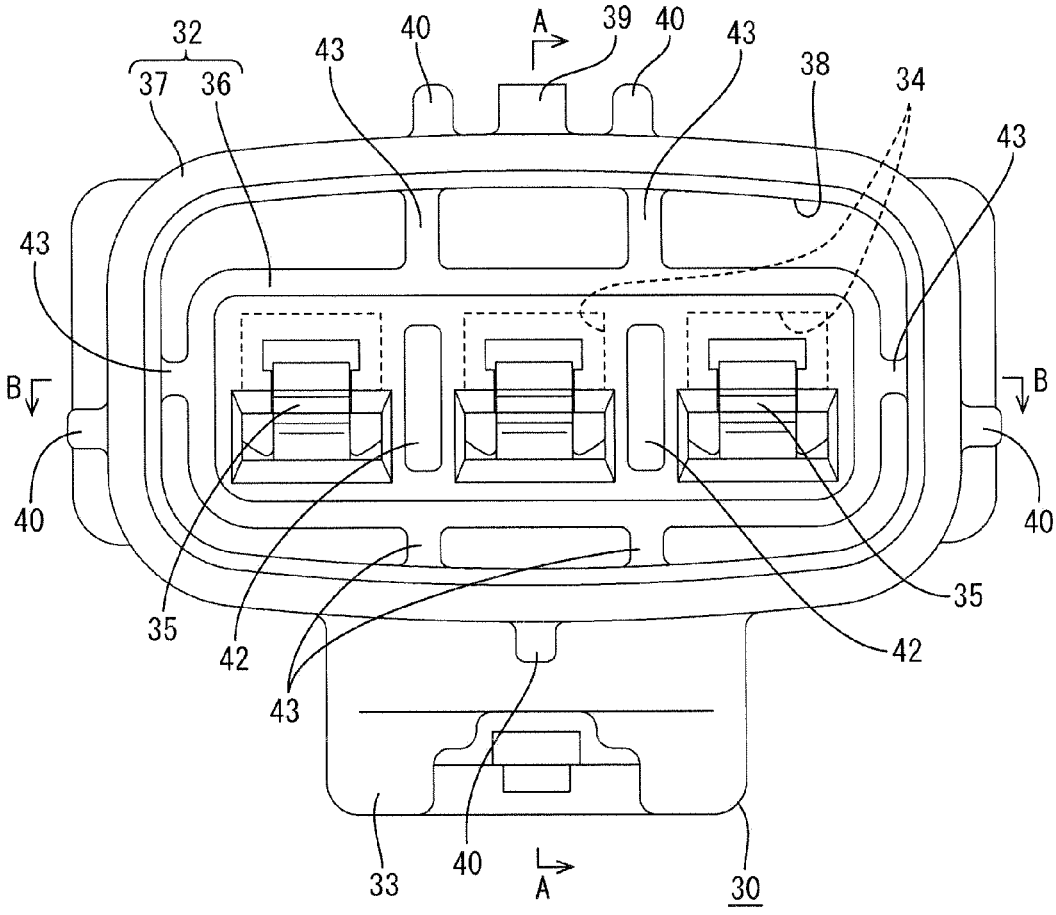
FIG. 1 is a front view of a male housing of one embodiment of the present invention.

The male housing 30 is made of synthetic resin. As shown in FIGS. 1, 7, and 8, the male housing 30 has a main body 31 for accommodating male terminal fittings connected respectively with ends of electric wires. The male terminal fittings and the wires are not shown in the drawings. A tubular part 32 projects forward from the main body 31. A bracket-mounting portion 33 is provided on the lower surface of the main body 31 for mounting the male housing 30 on a bracket.

The main body 31 of the male housing 30 defines an oblong block shape and has cavities 34 into which the male terminal fittings can be inserted from the rear. Three cavities 34 are arranged widthwise and penetrate the main body 31 longitudinally. A lance 35 is provided on a lower side of an inner peripheral surface of each cavity 34 for holding the inserted male terminal fitting in a removal-prevented state. The construction and function of the cavity 34 and the lance 35 are similar to those of the cavity 15 and the lance of the female housing 10. Therefore detailed description of the lance is omitted here. Similarly to the female housing 10, a waterproof rubber stopper is fit on an electric wire and is brought into close contact with a rear portion of the inner peripheral surface of the cavity 34.

The male housing 30 has a forwardly open oblong tubular part 32 that projects forward from a front-end surface 31*a* of the main body 31. The tubular part 32 enters into the space between opposed surfaces of the protection tube 12 and the fit-in portion 14 when the housings 10 and 30 are fit together. In other words, the protection tube 12 of the female housing 10 is fit on the outer side of the tubular part 32, whereas the fit-in portion 14 is fit in the inner side of the tubular part 32. The front-end surface 31*a* of the main body 31 is at a boundary between the main body 31 and the tubular part 32.

The tubular part 32 has inner and outer tubes 36 and 37. The inner tube 36 surrounds tabs of the male terminal fittings projected from the front-end surface 31*a* of the main body 31. The outer tube 37 surrounds the inner tube 36 and is spaced outward from the inner tube 36 so that a forwardly open annular groove 38 is formed therebetween. Thus the tubular part 32 is formed as a double tube. The inner tube 36 is longitudinally short and has a comparatively small cross section. The outer tube 37 is longer and has a comparatively large cross section. The tubular part 32 becomes thicker stepwise from the front thereof.

The front part 14*a* of the fit-in portion 14 of the female housing 10 can be fit in the inner tube 36. The length of the inner tube 36 is less than the length of the front part 14*a* of the fit-in portion 14 and the loosening prevention ribs 19 thereon, but is longer than a projected length of the tabs of the male terminal fitting from the front-end surface 31*a* of the main body 31. The inner tube 36 conforms to the outer configuration of the front part 14*a* of the fit-in portion 14, including the flat surfaces 27. The inner cross sectional dimensions of the inner tube 36 are slightly larger than the outer cross sectional dimensions of the front part 14*a* of the fit-in portion 14. The differences between the inner cross sectional dimensions of the inner tube 36 and the outer cross sectional dimensions of the front part 14*a* of the fit-in portion 14 are less than the projected dimensions of the loosening prevention ribs 19 with respect to the peripheral surface of the front part 14*a* of the fit-in portion 14. Therefore each of the loosening prevention ribs 19 is compressed slightly when the front part 14*a* of the fit-in portion 14 is fit in the inner tube 36 so that the inner tube 36 and the fit-in portion 14 will not loosen radially. The inner dimension of the inner tube 36 is less than the outer cross sectional dimension of the protrusion 25.

The protrusion 25 at the rear of the fit-in portion 14 can be fit in the outer tube 37. The length of the outer tube 36 is larger than the length of inner tube 36, and the difference between the lengths of the outer and inner tubes 37 and 36 exceeds the lengths of the protrusion 25 of the female housing 10 and the main body 20 of the seal ring 18. The outer tube 37 conforms to the outer configuration of the protrusion 25, including the curved surfaces 26 thereof. The inner cross sectional dimensions of the outer tube 37 exceed the outer cross sectional dimensions of both the inner tube 36 and the protrusion 25, but are less than the outer cross sectional dimensions of the main body 20 of seal ring 18. Therefore, the main body 20 is compressed by the front end of the outer tube 37 when the protrusion 25 is fit in the outer tube 37, and the gap between the female and males housing 10 and 30 is sealed.

A locking projection 39 is provided at a widthwise center of the upper side of the peripheral surface of the outer tube 37 for locked engagement with the locking arm 28. Guide ribs 40 are provided on both side surfaces at a lower peripheral part of the outer tube 37 and can enter the guide rib-receiving groove 29 of the female housing 10. Two guide ribs 40 also are formed at both sides of the locking projection 39 on the upper peripheral surface of the outer tube 37.

The groove 38 is formed between the inner and outer tubes 36 and 37 so that the front portion of the main body 31 defines a double tube similar to the tubular part 32. The rear portion of the groove 38 is defined partly by the peripheral walls of the cavities 34 on the inner tube 36 and a peripheral wall connected to the outer tube 37. The depth of the groove 38 with respect to the front end of the main body 31 exceeds the length of the tubular part 32. Rearwardly open bores 41 are formed on the rear surface of the male housing 30 (see FIGS. 7 and 8). The depth and configuration of the groove 38 are set so that uniform thicknesses exist between the groove 38 and both the bores 41 and the cavities 34.

Two forcible fit-in prevention pieces 42 project forward from the front-end surface 31*a* of the main body 31 and can be inserted into the receiving groove 17 of the female housing 10. The forcible fit-in prevention pieces 42 are long narrow plates disposed between the adjacent cavities 34 and are surrounded by the inner and outer tubes 36 and 37. The front end each forcible fit-in prevention piece 42 is forward of the front end of the inner tube 36 and rearward of the front end of the outer tube 37. That is, the forcible fit-in prevention piece 42 is longer than the inner tube 36 and shorter than the outer tube 37. Hence, the female housing 10 cannot be fit in the male housing 30 with the fit-in surface of the female housing 10 inclined to the normal fit-in posture for protecting the inner tube 36 and the male terminal fittings.

Opposed surfaces of the inner and outer tubes 36 and 37 are connected with one another by spaced apart reinforcements 43. More specifically, each reinforcement 43 is a longitudinally extending plate that connects the peripheral surfaces of the inner and outer tubes 36 and 37. The reinforcements 43 are disposed at two positions on each of the upper and lower surfaces of each of the inner and outer tubes 36 and 37 and at one position on each of the side surfaces thereof. Thus the reinforcements 43 are provided at six positions. The positions of the reinforcements 43 connecting the upper and lower surfaces of the inner and outer tubes 36 and 37 are widthwise coincident with the forcible fit-in prevention pieces 42 and the upper and lower loosening prevention ribs 19 of the female housing 10. Each reinforcement 43 is thicker than the inner tube 36, but thinner than the outer tube 37.

The reinforcements 43 are formed in the same longitudinal range as the groove 38. Thus, portions of the male housing 30 separated by the groove 38 are connected to each other over their entire lengths. More specifically, the reinforcements 43 connect the inner and outer tubes 36 and 37 over their entire lengths. The reinforcements 43 also connect the peripheral walls of the cavities 34 with the peripheral wall that is connected with the outer tube 37. A portion of the outer tube 37, including the front-end portion that contacts the seal ring 18, projects forward beyond the inner tube 36 and is not connected with the inner tube 36.

The male terminal fittings are inserted into the respective cavities 34 of the male housing 30 so that inner tube 36 surrounds and protects the tabs of the male terminal fittings and the lances 35 prevent the male terminal fittings from being removed. Similarly, the female terminal fittings are inserted into the respective cavities 15 of the female housing 10, and the lances 16 prevent the female terminal fittings from being removed. The seal ring 18 then is inserted into the protection tube 12 and is mounted on the fit-in portion 14 of the terminal accommodation part 11. The seal ring 18 is fit on the outer periphery of the protrusion 25 at the rear end of the fit-in portion 14, as shown in FIG. 6, and closely contacts the curved surfaces 26 on the outer periphery of the protrusion 25. The protection tube 12 surrounds and protects the seal ring 18 before the housings 10, 30 are fit together. As shown in FIG. 8, the ears fit in the respective ear-receiving concavities 23. Additionally, the removal prevention projections 22 penetrate the corresponding removal prevention openings 24, and the large-diameter portion of each removal prevention projection 22 is locked to the rear edge of each of the removal prevention openings 24 to hold the seal ring 18 irremovably.

As shown in FIGS. 7 and 8, the housings 10 and 30 are positioned so that their fit-in surfaces are parallel to each other. The tubular part 32 of the male housing 30 then is fit into the space between the protection tube 12 of the female housing 10 and the fit-in portion 14 thereof from the front of the female housing 10. The forcible fit-in prevention pieces 42 will not match the receiving grooves 17 if the fit-in surfaces of the housings 10 and 30 are inclined relative to each other. Thus, the forcible fit-in prevention pieces 42 will strike the front-end surface of the fit-in portion 14 or the outer tube 37 will interfere with the protection tube 12 to prevent a fit-in operation in an improper posture. The forcible fit-in prevention pieces 42 project forward beyond the inner tube 36. Thus, the fit-in portion 14 cannot interfere with the inner tube 36 or with the tabs of the male terminal fittings.

The forcible fit-in prevention pieces 42 enter the corresponding receiving grooves 17, and the guide ribs 40 enter the respective guide rib-receiving grooves 29 to guide a fit-in operation when the housings 10 and 30 are in a normal posture. The locking arm 28 rides over the locking projection 39 and elastically deforms, as the fit-in operation progresses. Thus, the front part 14*a* of the fit-in portion 14 advances into the inner tube 36. At this time, the loosening prevention ribs 19 on the flat surfaces 27 of the front part 14*a* of the fit-in portion 14 slide on the inner peripheral surface of the inner tube 36. As a result, the projected ends of the loosening prevention ribs 19 are compressed gradually from their front ends. The projected ends of the loosening prevention ribs 19 are tapered. As a result, a fit-in resistance generated by the compression of the loosening prevention ribs 19 increases only slightly. The inner peripheral surface of the front end of the outer tube 37 slides on the peripheral surface of the main body 20 of the seal ring 18 as the fit-in operation progresses, and the main body 20 is compressed radially.

The female and male terminal fittings contact conductively when the female and male housings 10 and 30 have been fit in each other to a normal depth, as shown in FIGS. 9 and 10. At this time, the locking arm 28 rides across the locking projection 39 and returns to its original state. Thus, the locking arm 28 engages the rear surface of the locking projection 39 to hold the female and male housing 10 and 30 together.

Figure 11:
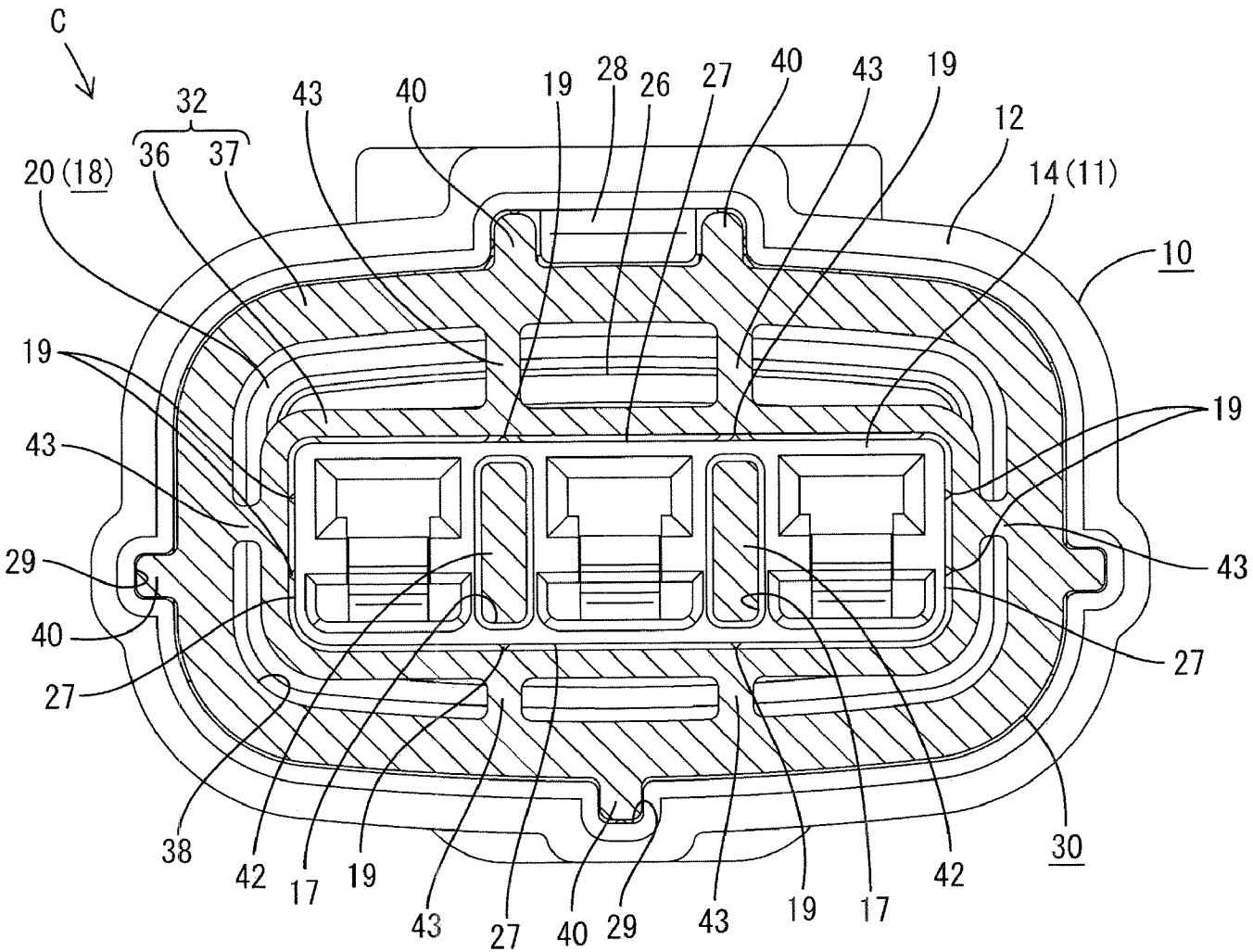
FIG. 11 is a sectional view taken along a line C-C of FIGS. 9 and 10.

The loosening prevention ribs 19 are at circumferentially spaced positions on the front part 14*a* of the fit-in portion 14 and closely contact the inner peripheral surface of the inner tube 36 over their entire lengths, as shown in FIG. 11 to prevent the properly connected housings 10, 30 from being loosened radially. Further each loosening prevention rib 19 is at a position where it longitudinally overlaps the front end of the female terminal fitting, which is connected with the tab of the male terminal fitting. Additionally, each loosening prevention rib 19 is directly outward from the front part 14*a* of the fit-in portion 14 that surrounds the female terminal fitting. Therefore, outside vibration will not affect a connection state between the female and male terminal fittings. In addition, the loosening prevention ribs 19 are circumferentially coincident with the respective reinforcements 43. Hence, a region of the inner tube 36 that closely contacts the loosening prevention ribs 19 is reinforced. As a result, the loosening prevention ribs 19 are very effective at preventing both housings 10, 30 from being loosened radially.

The main body 20 of the seal ring 18 is compressed radially between the protrusion 25 of the fit-in part 14 and the front end of the outer tube 37 in the fit-in state of the housings 10 and 30, as shown in FIGS. 9 and 10. Thus, the gap between the housings 10 and 30 is sealed. The main body 20 closely contacts the curved surfaces 26 on the outer periphery of the protrusion 25 to achieve a good sealing performance.

As described above, the main body 20 of the seal ring 18 is compressed between the outer tube 37 and the fit-in portion 14 when the housings 10 and 30 have been fit together. Thus, the main body 20 constantly applies a radially outward stress on the front end of the outer tube 37. The loosening prevention ribs 19 closely contact the inner tube 36, and the inner tube 37 is inward from the outer tube 37 with the groove 38 provided therebetween. Therefore unlike the case where the inner and outer tubes 36 and 37 are formed integrally with no gap therebetween, stress generated on the outer tube 37 by the seal ring 18 has little effect on the inner tube 36. Thus it is possible to keep the inner tube 36 in a favorable close contact with the loosening prevention ribs 19 and to prevent the loosening prevention function from deteriorating with age. The reinforcements 43 connect the inner tube 36 to the outer tube 37 at circumferentially spaced positions. However, the outer tube 37 extends forward from the inner tube 36, and the seal ring 18 closely contacts the extended front end of the outer tube 37. Therefore the stress has little effect on the inner tube 36.

As described above, the cylindrical part 32 of the male housing 30 has the inner and outer tubes 36 and 37 that are separated by the groove 38. Additionally, the loosening prevention ribs 19 are between the fit-in portion 14 of the female housing 10 and the inner tube 36 when the housings 10, 30 are connected and the seal ring 18 is between the outer tube 37 and the fit-in portion 14 of the female housing 10. Thus the stress applied to the outer tube 37 when the seal ring 18 is compressed between the connected housings 10 and 30 does not significantly affect the inner tube 36 because the loosening prevention ribs 19 are between the fit-in portion 14 and the inner tube 36. Thus, the loosening prevention function will not deteriorate with age. Furthermore, the seal ring 18 is mounted by utilizing the space of the groove 38 between the inner and outer tubes 36 and 37 so that the connector C is radially compact.

The groove 38 extends to a position rearward of the loosening prevention ribs 19 and the seal ring 18 when the female and male housings 10 and 30 have been fit together. Therefore the stress applied to the outer tube 37 by the compressed seal ring 18 does not significantly affect the inner tube 36. The groove 38 thins the main body 31 of the male housing 30 so that shrink marks are not likely to be generated in molding the resin for the male housing 30. Thus, the cylindrical part has a high dimensional accuracy, and a high sealing performance can be obtained.

The seal ring 18 is compressed by the front end of the outer tube 37. Thus, the stress to be applied to the inner tube 36 is much lower than if the seal ring is compressed at a rear side of the outer tube 37.

The outer tube 37 projects forward beyond the inner tube 36 and the reinforcements 43 connect the inner tube 36 with laterally spaced regions of the outer tube 37 rearward from the portion thereof that contacts the seal ring 18. Therefore, the inner tube 36 is stronger and the loosening preventing function performed by the loosening prevention ribs 19 is enhanced. The seal ring 18 contacts the front end of the outer tube 37 and the reinforcements 43 do not connect the front end of the outer tube 37 with the inner tube 36. Thus, the seal ring 18 does not apply significant stress to the inner tube 36. The reinforcements 43 are circumferentially coincident with the loosening prevention ribs 19 to obtain a high loosening prevention function.

In addition, the forcible fit-in prevention pieces 42 project forward from the rear wall of the inner tube 36 and prevent the female housing 10 from being fit in the male housing 30 with the fit-in surface of the female housing 10 inclined to the normal fit-in posture. The front-end of the forcible fit-in prevention piece 42 is between the front-ends of the inner and outer tubes 36 and 37. Therefore the forcible fit-in prevention piece 42 prevents the female housing 10 from interfering with the inner tube 36 with the fit-in surface of the female housing 10 inclining to the normal fit-in posture thereof and is protected by the outer tube 37. The prevention of interference between the female housing 10 and the inner tube 36 prevents deformation of the inner tube 36. Hence, the loosening prevention ribs 19 on the fit-in portion 14 display a favorable loosening preventing function against the inner tube 36.

A loosening prevention portion conceivably could be a part separate from the female housing. However, such a loosening prevention portion could loosen and slip out of place while mounting on the female housing. In contrast, the loosening prevention ribs 19 of the invention are formed unitarily with the female housing 10 and cannot loosen or shift. Thus, the loosening prevention ribs 19 securely display the loosening prevention function and decrease the number of parts and the number of assembling steps.

The seal ring 18 is mounted on the curved surfaces 26 that are formed on areas of the fit-in portion 14 that confront the cylindrical part 32. The flat surfaces 27 are forward of the curved surfaces 26 and have the loosening prevention ribs 19 formed unitarily thereon. The curved surfaces 26 provide a preferable sealing performance and the formation of the loosening prevention ribs 19 unitarily with the flat surface 27 facilitates dimensional management. Thus, a high sealing performance and a good loosening prevention function are achieved.

The protrusion 25 projects radially out from a portion of the fit-in portion 14 rearward the flat surfaces 27 and the curved surfaces 26 are formed on the protrusion 25. Thus the flat surfaces 27 are farther inward that the curved surfaces 26, and the loosening prevention ribs 19 will not interfere with the seal ring 18 while mounting the seal ring 18 on the fit-in portion 14. Accordingly, the seal ring 18 will not be damaged and the sealing performance will not deteriorate.

The invention is not limited to the embodiment described above with reference to the drawings. For example, the following embodiments are included in the technical scope of the invention.

The above-described groove 38 is formed rearward from the fit-in surface of the male housing 30. But the depth of the groove portion can be changed. For example, the rear end of the groove may be coincident with the fit-in surface of the male housing or disposed forward from the fit-in surface thereof.

The number, shapes and positions of the reinforcements can be changed. The invention includes a construction in which the reinforcements are omitted and the inner and outer tubes are formed independently without connecting confronting surfaces together. This construction securely prevents the stress of the seal ring from affecting the inner cylindrical portion.

The female housing has the loosening prevention ribs in the preceding embodiment. However, the loosening prevention portions may be formed on the inner peripheral surface of the inner tube of the male housing, and both female and male housings may be provided with the loosening prevention portions.

The seal ring is mounted on the female housing in the above-described embodiment. However, the seal ring may be mounted on the inner peripheral surface of outer tube of the male housing.

The loosening prevention ribs are between the inner tube and the fit-in portion, and the seal ring is between the outer tube and the fit-in portion in the above-described embodiment. However, the seal ring can be between the outer tube and the fit-in portion, and a loosening prevention portion can be between the inner tube and the fit-in portion.

The loosening prevention ribs are formed integrally with the female housing in the above-described embodiment. However, a loosening prevention portion can be a separate component from the female housing. The separate component may be dedicated for loosening prevention to prevent removal of a terminal fitting (front retainer and side retainer).

The front end of the outer tube is brought into close contact with the seal ring in the above-described embodiment. However, the rear end thereof could be brought into close contact with the seal ring.

The outer tube projects forward beyond the inner tube in the above-described embodiment. However, the outer and inner tubes may be coincident with each other or the inner tube may project forward beyond the inner tube.

The female housing has the protection tube surrounding the fit-in portion in the above-described embodiment. However, the female housing need not have the protection tube.

The curved surfaces are formed on the upper and lower surfaces of the protrusion of the fit-in portion. However, the curved surfaces can be formed entirely on the protrusion. The fit-in portion need not have the protrusion and the sectional dimension may not change over the full length thereof.

The flat surfaces are formed at the front of the fit-in portion and the curved surfaces are formed at the rear of the fit-in portion in the above-described embodiment. However, the flat surface may be formed at the rear of the fit-in portion and the curved surfaces may be formed on the front of the fit-in portion. The invention also includes a fit-in portion that does not have the flat surfaces and has a periphery formed entirely as curved surfaces.

The bracket-mounting portion is provided on the male housing in the above-described embodiment, but may be provided on the female housing. It is possible to omit the bracket-mounting portion.

The male housing has the outer and inner tubes in the above-described embodiment. However, the female housing may be have the outer and inner tubes. The male terminal fitting is connected to an end of an electric wire in the above-described embodiment. However, the terminal fitting may be inserted into the housing.

What is claimed is:

1. A connector comprising:

a first housing having a tubular part with inner and outer tubes and a groove therebetween;

a second housing having a fit-in portion to be fit in the tubular part;

a seal ring compressed between opposed surfaces of the outer tube and the fit-in portion to seal a gap between the first and second housings; and loosening prevention portions formed integrally with one of the inner tube and the fit-in portion to fill a gap between said opposed surfaces of the inner tube and the fit-in portion and preventing the first and second housings from being loosened radially.

2. The connector of claim 1, wherein said groove extends rearward of said loosening prevention portions and said seal ring in a state in which said first and second housings have been fit together.

3. The connector of claim 1, wherein said seal ring is compressed by a front end of said outer tube.

4. The connector of claim 1, wherein said outer tube projects forward beyond said inner tube; and reinforcements connect said inner and outer tubes at regions of said outer tube rearward from a portion of said outer tube that contacts said seal ring.

5. The connector of claim 4, wherein said reinforcements align with said loosening prevention portions.

6. The connector of claim 1, wherein said outer tube projects forward beyond said inner tube; a forcible fit-in prevention piece projects forward from a rear wall of said inner tube for preventing said second housing from being fit in said first housing with said first housing inclined to a normal fit-in posture thereof; and a front-end of said forcible fit-in prevention piece is between front-ends of said inner and outer tubes.

7. The connector of claim 1, wherein said seal ring is mounted on a surface of said fit-in portion opposed to said outer tube; and said loosening prevention portion is provided on said surface of said fit-in portion opposed to said inner tube; and curved surfaces are formed on portions of said fit-in portion, on which said seal ring is mounted; and flat surfaces are formed at positions forward from said curved surfaces, said loosening prevention portions being formed integrally on said flat surfaces.

8. The connector of claim 7, wherein a protrusion protrudes out from a position rearward from said flat surfaces of said fit-in portion; and said curved surfaces are formed on said protrusion.

9. A connector comprising:

a first housing having a tubular part;

a second housing having opposite front and rear ends spaced longitudinally from one another, a fit-in portion substantially adjacent the front end of the second housing and configured to be fit in said tubular part, the fit-in portion having at least one curved surface and at least one flat surface spaced longitudinally from the curved surface;

a seal ring mounted on the curved surface of said fit-in portion and compressed between said curved surface of said fit-in portion and an opposed surface of said tubular part to seal a gap between said first and second housing; and loosening prevention portions formed integrally on the flat surface of the fit-in portion, which is mounted on a surface of said fit-in portion opposed to said tubular part, said loosening prevention portions being dimensioned to contact an opposed surface of said tubular part for preventing said first and second housings from being radially loosened.

10. The connector of claim 9, wherein said flat surface is disposed on said fit-in portion forward from said curved surface.

11. The connector of claim 9, wherein a protrusion is formed on said fit-in portion rearward from said flat surface and protrudes out farther than said flat surface, said curved surface being formed on said protrusion.

12. The connector of claim 9, wherein said tubular part comprises inner tube, an outer tube outward of the inner tube and a groove between said inner and outer tubes, the inner tube contacting one of said seal ring and said loosening prevention portions, the outer tube contacting the other of said seal ring and said loosening prevention portion.

13. The connector of claim 12, wherein at least part of said groove is rearward from said loosening prevention portions and said seal ring when said housings have been fit together.

14. The connector of claim 12, wherein said seal ring is compressed by a front end of one of said inner and outer tubes.

15. The connector of claim 12, wherein said loosening prevention portion contacts said inner tube and said seal ring contacts said outer tube.

16. The connector of claim 15, wherein said outer tube projects forward beyond said inner tube, and reinforcements connect said inner and outer tubes at regions of said outer tube rearward from a portion of said outer tube that contacts said seal ring.

17. The connector of claim 16, wherein said reinforcements align with said loosening prevention portions.

18. The connector of claim 15, wherein said outer tube projects forward beyond said inner tube; a forcible fit-in prevention piece projects forward from a rear wall of said inner tube for preventing said second housing from being fit in said first housing with said first housing inclined to a normal fit-in posture thereof; and a front-end of said forcible fit-in prevention piece is between front-ends of said inner and outer tubes.

* * * * *